United States Patent [19]

Juell

[11] Patent Number: 4,924,642

[45] Date of Patent: May 15, 1990

[54] DEVICE FOR MOUNTING DOORS AND WINDOWS

[76] Inventor: Per A. Juell, Kildeveien 21c, Oslo 5, Norway, 0590

[21] Appl. No.: 170,176

[22] Filed: Mar. 18, 1988

[30] Foreign Application Priority Data

Mar. 20, 1987 [NO] Norway ..... 871152

[51] Int. Cl.[5] ..... E06B 1/04

[52] U.S. Cl. ..... 52/217; 52/712

[58] Field of Search ..... 52/213, 217, 712, DIG. 6, 52/214, 215

[56] References Cited

U.S. PATENT DOCUMENTS

| | | | |
|---|---|---|---|
| 816,297 | 3/1906 | Charls | 52/712 |
| 1,451,012 | 4/1923 | Ellison | 52/214 |
| 2,190,354 | 2/1940 | Downes | 52/215 |
| 2,483,560 | 10/1949 | Peterson | 52/712 X |
| 2,527,985 | 10/1950 | Burroway | 52/712 |
| 3,005,293 | 10/1961 | Hunter | 52/712 X |
| 3,041,678 | 7/1962 | Copp, Jr. | 52/214 |
| 3,394,516 | 7/1968 | Taylor et al. | 52/712 X |
| 4,288,958 | 9/1981 | Chalmers et al. | 52/712 X |
| 4,488,391 | 12/1984 | Pavnica | 52/213 X |
| 4,756,136 | 7/1988 | Hodges | 52/712 X |

OTHER PUBLICATIONS

Sweets, Catalog File, 1985, Special Joist Anchors and PA Holdowns & Purlin Anchors.

*Primary Examiner*—Carl D. Friedman

*Attorney, Agent, or Firm*—Townsend & Townsend

[57] ABSTRACT

A device for firmly holding a frame adjacent to a construction member comprising a piece of sheet having marks for bending in the form of material remaining when an aperture is stamped out. The side of the stamped out aperture extending aligned with marks for bending is provided with serrations. Edges at the ends are also provided with serrations which will engage firmly in adjacent material when the device takes a zigzag shape in a space between members after compression in the longitudinal direction by the aid of a tool cooperating with hooks on the device. Said tool comprises two members which are movable relative to each other by a force exerting means. A device which is caught with hooks on the movable member and on a projecting on the other tool member is, thus, compressed in the longitudinal direction when said force exerting means is actuated.

5 Claims, 2 Drawing Sheets

DEVICE FOR MOUNTING DOORS AND WINDOWS

The present invention relates to a device for mounting doors and windows on adjacent construction members.

Windows and doors are commonly secured by the aid of wedges at first, and then screws or nails are secured through the frame. When there is a varying distance between frame and adjacent construction member this ask may become time consuming, especially if wedges are whittled from any bits or pieces of wood found on the building site. For this reason various kinds of fastener means were preiously proposed, and embodiments of such fastener means are disclosed in European Patent Application No. 0147,563 and DE-OS Nos. 24 05 838 and 24 26 080. These known fastener means, however, have the disadvantage in common that they comprise a plurality of components and, thus, are expensive in production. Furthermore, mounting is time consuming and requires careful adaption and much manipulation if the fastener means are to exert correct holding force withput deformation and bending of the frame means.

It is an object of the present invention to provide a device for mounting doors and windows eliminating the above mentioned disadvantages. The new device may be manufactured in a simple and inexpensive manner by stamping operations, and the device can be mounted rapidly by the aid of a simple tool.

According to the invention this is achieved by the fact that the device comprises an elongated piece of metal sheet which has notches for bending causing the piece of metal sheet to bend in a zigzag shape when it is compressed in the longitudinal direction by the aid of the tool.

Figure 1:
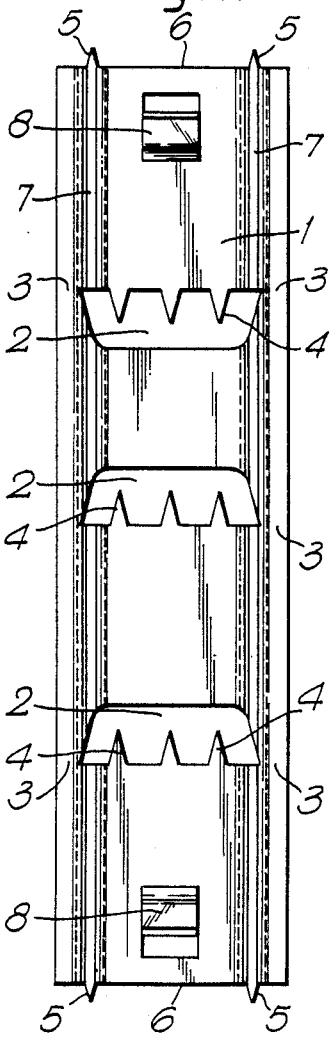
Figure 3:
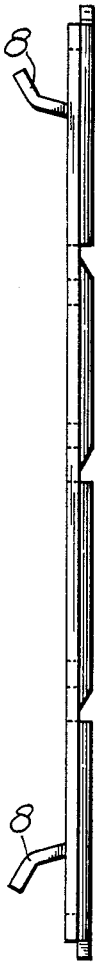
Figure 4:
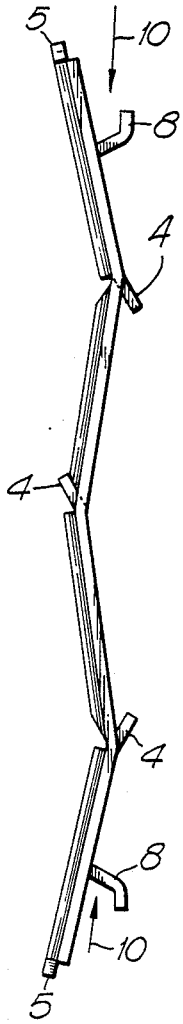
Figure 2:
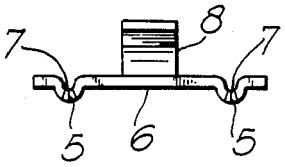
Figure 5:
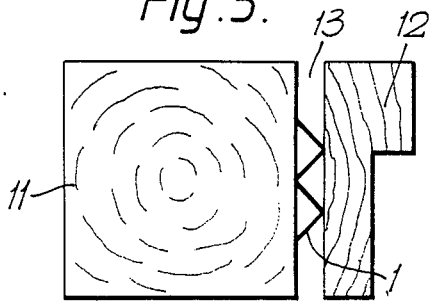
Figure 6:
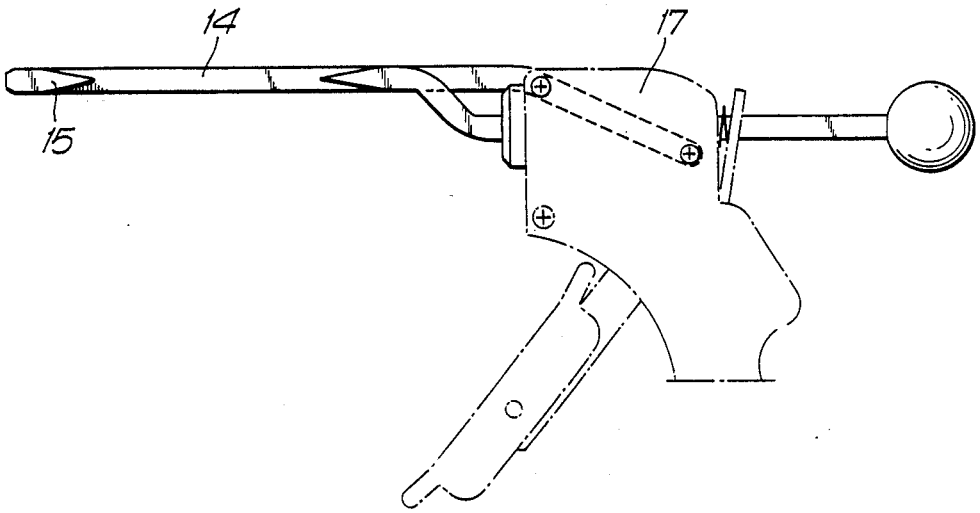

The invention is characterized by the features stated in the claims and will be disclosed in more detail below with reference to the drawing where FIG. 1 shows a device according to the invention in side elevation, FIG. 2 shows the device as seen from one end, FIG. 3 shows the device as seen from a longitudinal edge during one step of manufacture, FIG. 4 shows the device in a state ready for use, FIG. 5 shows the performance of the device, FIG. 6 shows a tool in a side elevation and much simplified, for use in mounting doors and windows by the aid of the device illustrated in FIGS. 1–3, and FIG. 7 shows the tool of FIG. 6 in a plan view.

The device according to the invention comprises a stamped out piece of metal sheet 1, which in the preferred embodiment may be 80 mm long and consist of, e.g. chrome steel with a thickness of 1 mm. The width of the piece of sheet in FIG. 1 is 22 mm. Sheet member 1 is provided with a plurality of stamped out apertures 2 with narrow portions of material l3 remaining to form weakenings or notches for bending. At the edges which extend aligned with said notches for bending apertures 2 have serrations 4 facing into the aperture, and the end edges of the sheet member 1 are serrated 1. The portions of sheet member 1 extending between the ends 6 and between apertures 2 are provided with reinforcing embossings 7 causing these areas to be more rigid than a plane sheet. At each end the device is provided with bosses or hooks 8 which in the shown embodiment are formed by a stamped out flap of sheet. Hooks 8 are intended for cooperation with the tool disclosed below.

After the flat sheet blank 1, shown in FIGS. 1–3, is stamped out it is preliminary bent, as shown in FIG. 4. In this manner the device can be compressed in the longitudinal direction more readily when forces are exerted in the directions indicated by arrows 10. The performance is diagrammatically shown in FIG. 5, where a column 11 constitutes a structural member, e.g. facing a door frame 12. In the space 13 between column and door frame a suitable number of devices 1, e.g. three devices evenly spaced over the height of a door are provided, although a larger number of devices may be used if necessary. Device 1 is compressed in the longitudinal direction and the zigzag shape will fill space 13 as shown. Serrations 4 and 5 will, thus, engage in the adjacent surfaces to keep frame 12 firmly locked in said space, e.g. in framework or concrete or steel, depending on the material of the structure.

Figure 7:
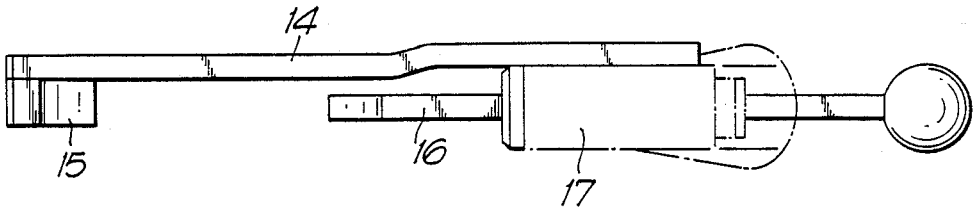

Compression in the longitudinal direction is achieved by a tool which may be of the kind as shown in FIGS. 6 and 7. The tool comprises two main members one of which 14 is elongated and provided with a projection 15. As shown in FIG. 6 the elongated member 14 is designed with a cross sectional dimension small enough to permit insertion in the spave 13 between structural member 11 and frame 12. The other member 16 of the tool is movable and can be driven towards the left side in FIGS. 6 and 7 by the aid of a tensioning means 17 when a means of the embodiment shown in FIG. 4 is inserted in the tool with hooks 8 engaged with projection 15, and movable part 16, respectively. Tensioning means 17 will not be described in detail since it may be hydraulic, pneumatic, electric, or even mechanic in the most simple design, as tensioning means previously known from pistols for cartridges with glue for mounting or mastic. By the aid of tensioning means 17 forces indicated by arrows 10 in FIG. 4 are exerted after the tool and the inserted device is provided in opening 13 as mentioned above.

The shown embodiment only serves to illustrate the invention and other embodiments of the device are possible within the scope of the invention. Screw apertures may, inter alia, be provided to secure the device to a frame or structural member before compression in the longitudinal direction, or it may be pretreated with glue which is covered, e.g. by removable paper until the device is used.

I claim:

1. A device for mounting a frame to an adjacent construction member, comprising:

an elongated strip of metal sheet including a hook at an end thereof;

said hook projecting from a plane of the strip end and being adapted to receive a compressive force from a tool for compressing said strip longitudinally;

said strip defining openings whose longitudinal edges form bending notches;

said strip bending into a zig-zag shape along said bending notches upon application of a compressive force at said hook such that a space between said frame and adjacent construction member is filled by said bent strip.

2. A device for mounting a frame to an adjacent construction member, comprising:

an elongated strip of metal sheet including a hook at an end thereof;

said hook projecting from a plane of the strip end and being adapted to receive a compressive force from a tool for compressing said strip longitudinally;

said strip defining transversely elongated openings formed by stamping, wherein longitudinal edges of said openings form bending notches;

the metal between an end edge of said strip and a transversal edge of the opening forming a bending joint whereat the strip will bend under compression; and said strip bending into a zig-zag shape along said bending notches upon application of a compressive force at said hook such that a space between said frame and adjacent construction member is filled by said bent strip.

3. A device for mounting a frame to an adjacent constrution member, comprising:

an elongated strip of metal sheet including a hook at an end thereof;

said hook projecting from a plane of the strip end and being adapted to receive a compressive force from a tool for compressing said strip longitudinally;

said strip defining openings whose longitudinal edges form bending notches wherein a longitudinal edge of said openings is serrated, a serrated transverse edge forming an outermost projection of said strip when the strip is bent under compression; and said strip bending into a zig-zag shape along said bending notches upon application of a compressive force at said hook such that a space between said frame in adjacent construction member is filled by said bent strip.

4. A device for mounting a frame to an adjacent construction member, comprising:

an elongated strip of metal sheet including a hook and an end thereof;

said hook projecting from a plane of the strip end and being adapted to receive a compressive force from a tool for compressing said strip longitudinally;

said strip defining openings whose longitudinal edges form bending notches and wherein a transverse end of said strip is serrated; and said strip bending into a zig-zag shape along said bending notches upon application of a compressive force at said hooks such that a space between said frame and adjacent construction member is filled by said bent strip.

5. A device for mounting a frame to an adjacent construction member, comprising:

an elongated strip of metal sheet including a hook and an end thereof;

said hook projecting from a plane of the strip end and being adapted to receive a compressive force from a tool for compressing said strip longitudinally;

said strip defining openings whose longitudinal edges form bending notches;

reinforcing embossings positioned along opposite longitudinal edges of said strip; and said strip bending into a zig-zag shape along said bending notches upon application of a compressive force at said hook such that a space between said frame and adjacent construction member is filld by said bent strip.

* * * * *